United States Patent [19]

Rehtmeyer et al.

[11] Patent Number: 4,979,324

[45] Date of Patent: Dec. 25, 1990

[54] FRAME FOR DISPLAYING OUTFITS OR ENSEMBLES

[75] Inventors: Carol A. Rehtmeyer, Wheaton, Ill.; Craig F. Yoe, New York, N.Y.

[73] Assignee: Pressman Toy Corporation, New York, N.Y.

[21] Appl. No.: 477,647

[22] Filed: Feb. 9, 1990

[51] Int. Cl.[5] ..... A63F 3/00; G09B 19/10; G09B 19/00; G09F 19/00

[52] U.S. Cl. ..... 40/490; 273/254; 273/276; 273/DIG. 14; 434/94; 434/99; 446/321

[58] Field of Search ..... 273/276, 283, 284, 287, 273/254, DIG. 14; 434/94, 99, 396, 371, 370; 40/156, 159, 490; 446/97, 99, 387, 321

[56] References Cited

U.S. PATENT DOCUMENTS

| | | | |
|---|---|---|---|
| 2,295,325 | 9/1942 | Belden | 434/99 |
| 3,817,531 | 6/1974 | King et al. | 273/243 |
| 4,003,577 | 1/1977 | Bolach | 273/287 |

FOREIGN PATENT DOCUMENTS

| | | | |
|---|---|---|---|
| 1136724 | 12/1968 | United Kingdom | 434/94 |
| 2189159 | 10/1987 | United Kingdom | 273/254 |

*Primary Examiner*—Benjamin Layno

[57] ABSTRACT

A board game on which the players simulate a shopping trip to a mall by moving their distinctive markers along a route defined by rectangles depicting stores of various types. A spinner determines the number of squares a player moves her marker during a turn. Playing cards having decorative portions of different designs are stacked in storage areas, each associated with a rectangle of a store. Each player has a frame with a plurality of cavities for receiving and depicting the decorative portions of the cards. A player wins the game by being the first to fill all of the cavities in her frame with cards having decorative portions of the same design. A replica of an outfitted mannequin is formed on the front face of the frame. Several windows of transparent material are formed in the front face of the frame within the replica of the mannequin so that the decorative portions of the cards which are inserted in the frame will be visible as portions of the outfit of the mannequin.

2 Claims, 1 Drawing Sheet

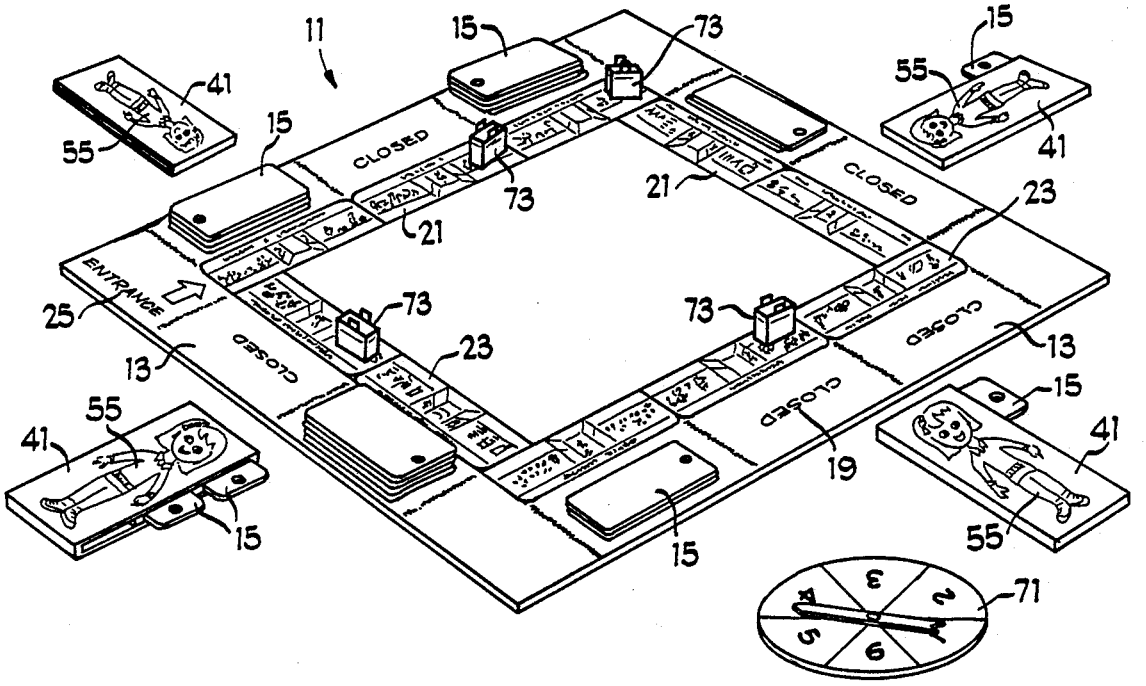
Fig 1
Fig 2
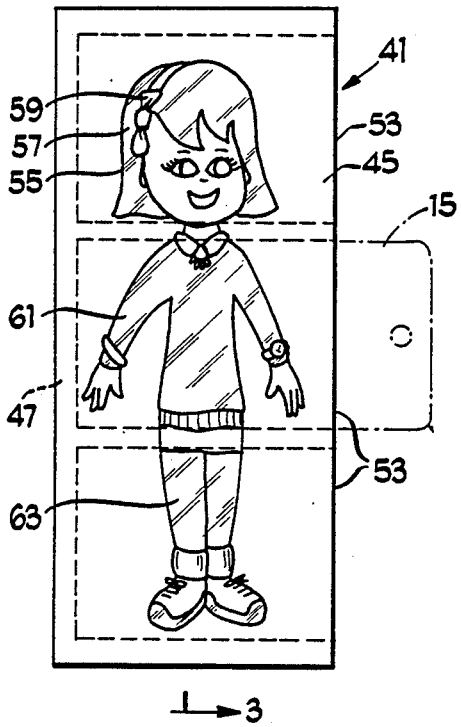
Fig 3
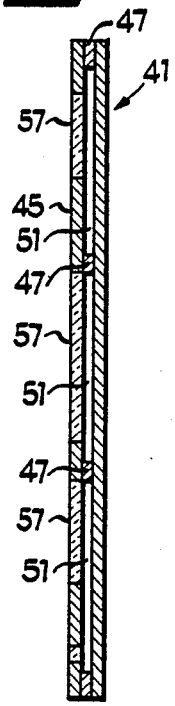
Fig 4
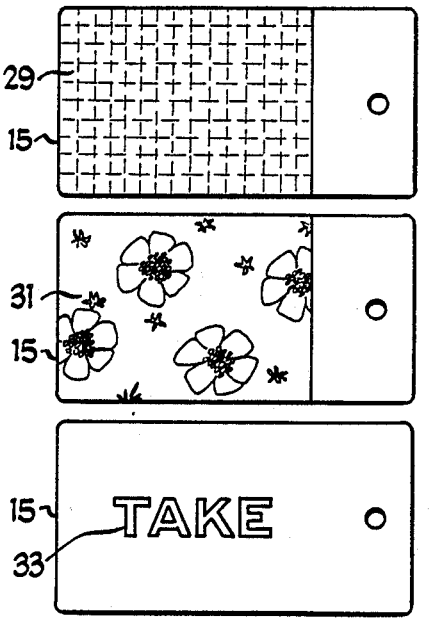

FRAME FOR DISPLAYING OUTFITS OR ENSEMBLES

BACKGROUND AND SUMMARY OF THE INVENTION

This invention is directed to a frame and cards used for playing a board game in which the players simulate a shopping trip to a mall.

An object of this invention is to display matching outfits or ensemble using a frame containing a replica of a mannequin clothed in an outline of an outfit or ensemble with several windows created in the outline of the outfit so that the design and color of the components of the mannequin's outfit may be changed by alternatively inserting decorative cards into the frame.

Other objects may be found in the following specification, claims and drawings.

BRIEF DESCRIPTION OF THE DRAWINGS

The invention is illustrated more or less diagrammatically in the following drawings wherein:

FIG. 1 is a perspective view of the board game of this invention, with the component parts shown in their playing positions;

FIG. 2 is an enlarged, top plan view of one of the frames shown in FIG. 1, with a card shown in phantom inserted in one of the cavities of the frame;

FIG. 3 is a cross-sectional view of the frame taken along line 3—3 of FIG. 2; and FIG. 4 is an enlarged, top plan view of several decorative cards of the type which may be used in playing the game of this invention.

DESCRIPTION OF THE PREFERRED EMBODIMENT

FIG. 1 of the drawings shows a game board 11 with its component parts and accessories shown in their playing position. This game board may be made in a conventional manner of a hard piece of cardboard or paper which may, or may not, fold in the center, depending upon its size, with printing to indicate the decorative and functional features of the game applied to the upper surface of the board. An outer series of rectangles 13 are printed around the periphery of the board. These rectangles form storage areas for stacks of playing cards 15. Some of the rectangles designate vacant stores, and these are indicated by the printed indicia 19 which reads "closed". Stacks of playing cards 15 are not provided on the "closed" rectangles. There is another series of rectangles located inside the outer ring of rectangles 13, and these rectangular spaces 21 bear printed indicia 23 of a design or lettering or both, indicating a particular type of store. One of the outer rectangles 13, at a corner of the game board 11, is marked with indicia 25 indicating the entrance to the route of store spaces 21. As is shown in the drawings, an arrow is provided next to the indicia 25 to indicate to the players where to start the game.

Representative playing cards 15 are shown in FIG. 4 of the drawings with the cards having different indicias, such as indicia 29 which is intended to represent the use of color and a fabric design, and indicia 31 which represents the use of a floral design and color. It should be understood that these indicias are merely representative of the myriad colors, designs or combinations of colors and designs that may be used as decorative indicia on the cards 15. Because of the nature of the game, sufficient cards should be provided so that at least three cards have the same decorative indicia 29 or 31. A card 15 shown at the bottom of FIG. 4 has indicia 33 which is the word "take" instead of decorative indicia 29 or 31. If a player obtains this type of card, the player is entitled to take a decorative playing card 15 from any other player in the game who has such a card. Preferably there are four different sets of indicia 29 and 31, so each one of the players can eventually obtain one complete set of cards 15 bearing the same type of indicia 29 and 31.

Each player also has a frame 41 in which the playing cards 15 are to be inserted with their decorative indicia 29 or 31 facing upwardly, as viewed in the drawings. Each frame consists of a rectangular back member 43 which may be formed of opaque plastic or suitable cardboard and a face or front member 45 which may be formed at least in part of a transparent plastic. The back member and face are separated by spacers 47 formed around the periphery of three sides of the frame, as well as two transversely-extending spacers to divide the frame into three segmented cavities 51, each having an open edge 53. The front and back members and spacers may be glued to each other or fastened in any conventional manner.

An image 55 showing the outline and some physical and attire portions of a mannequin representing a young girl is printed on the upper surface of the face 53, leaving unprinted, transparent windows 57. One window 57 is provided over each of the three cavities 51 of the frame. In this embodiment of the invention, one window would be inside the portion of the image 55 depicting a ribbon 59 worn on the head of the mannequin; a second window 57 would be inside the portion of the image 55 depicting the sweater 61 in the center cavity and a third window would be inside the portion of the image 55 depicting the pants 63 in the bottom cavity. Thus, it is apparent that when a decorative card 15 having an indicia, such as indicia 29 or 31, is inserted into a cavity of the frame 41, its decorative indicia will show through the front face 45 only at the window 57 of the ribbon, the sweater or the pants. Instead of making the entire face 45 of the frame 41 of transparent material, it could be made, as shown in the drawings, with opaque portions bearing the image 55 formed of plastic material and only the window portions 57 made of a transparent plastic.

The game board 11 also comes with a number selecting spinner 71 and plastic markers 73 which are formed as miniature shopping bags, each of a different color, so that each player can have a marker of a distinctive color.

The object of the game is for the first player to obtain three playing cards 15 from the stacks of cards located in the storage areas of the game board having the same indicia 29 or 31 on the cards so that the player can put these three cards into the cavities 51 of her frame 41 and, thus, dress its mannequin 55 in a matching outfit. A player starts by spinning the spinner 71 and moving her plastic marker 73 along the route of inner rectangles 21 until the marker stops on a rectangle in front of an open store 23. The player then is permitted to take one of the playing cards 15 which are positioned face down in the storage area next to the store 23 and insert this card in her frame. The game continues until one player obtains three playing cards 17 with the same indicia thereon.

What is claimed is:

1. A frame and a plurality of cards, said frame having a front face with an image depicted on said front face, each of said cards having a decorative portion, means dividing said front face with an image depicted on said front face, each of said cards having a decorative portion, means dividing said front face of said frame into a plurality of segments with each segment containing at least a portion of said image, a window formed in a portion of said image at each segment, and a cavity formed in each segment of said frame behind said front face with each cavity formed and adapted to receive one of said cards having a decorative portion with said card positioned in said cavity so that the decorative portion of the card is visible through said window and said face.

2. The frame and cards of claim 1 in which said windows are formed by transparent portions of said front face of said frame.

* * * * *